US012797707B2

(12) United States Patent
Díaz Martinez

(10) Patent No.: US 12,797,707 B2
(45) Date of Patent: Nov. 17, 2026

(54) CYCLING TRAINING DEVICE

(71) Applicant: Dynamic Cycling, S.L., Gipuzkoa (ES)

(72) Inventor: Aitor Díaz Martinez, Guipuzcoa (ES)

(73) Assignee: Dynamic Cycling, S.L., Gipuzkoa (ES)

( * ) Notice: Subject to any disclaimer, the term of this patent is extended or adjusted under 35 U.S.C. 154(b) by 307 days.

(21) Appl. No.: 18/709,287

(22) PCT Filed: Nov. 12, 2021

(86) PCT No.: PCT/ES2021/070818

§ 371 (c)(1),
(2) Date: Dec. 23, 2024

(87) PCT Pub. No.: WO2023/084133

PCT Pub. Date: May 19, 2023

(65) Prior Publication Data

US 2025/0222332 A1 Jul. 10, 2025

(51) Int. Cl.

*A63B 69/16* (2006.01)
*A63B 22/00* (2006.01)
*A63B 22/06* (2006.01)

(52) U.S. Cl.

CPC ..... *A63B 69/16* (2013.01); *A63B 22/0046* (2013.01); *A63B 2022/0641* (2013.01); *A63B 2069/161* (2013.01); *A63B 2069/164* (2013.01)

(58) Field of Classification Search

CPC ..... A63B 21/00058; A63B 21/015; A63B 22/0046; A63B 69/16; A63B 2022/0641; A63B 2069/161; A63B 2069/162; A63B 2069/164; A63B 2069/165; A63B 2225/09

See application file for complete search history.

(56) References Cited

U.S. PATENT DOCUMENTS

| | | | | |
|---|---|---|---|---|
| 4,951,937 | A | 8/1990 | Hoffenberg et al. | |
| 8,430,797 | B2 * | 4/2013 | Wan | A63B 71/0619 482/61 |
| 9,440,109 | B2 * | 9/2016 | Irving | A63B 21/015 |
| 9,669,257 | B2 * | 6/2017 | Irving | A63B 22/0015 |
| 10,702,736 | B2 * | 7/2020 | Weston | A63B 22/0605 |
| 11,235,199 | B2 * | 2/2022 | Irving | A63B 23/02 |
| 11,931,623 | B2 * | 3/2024 | Irving | A63B 21/015 |
| 11,975,235 | B2 * | 5/2024 | Pacheco Hernandez | A63F 13/245 |
| 11,992,725 | B2 * | 5/2024 | Bass | A63B 69/16 |
| 2010/0234188 | A1 * | 9/2010 | Wan | A63B 21/15 482/61 |
| 2011/0287901 | A1 * | 11/2011 | Wan | A63B 22/0023 482/57 |
| 2012/0238412 | A1 | 9/2012 | Hamilton | |
| 2012/0302403 | A1 * | 11/2012 | Touret | A63B 22/0605 482/4 |

(Continued)

FOREIGN PATENT DOCUMENTS

| | | | |
|---|---|---|---|
| CN | 102755724 | A | 10/2012 |
| CN | 205598592 | U | 9/2016 |

*Primary Examiner* — Joshua Lee
(74) *Attorney, Agent, or Firm* — Hayes Soloway PC

(57) ABSTRACT

The present invention relates to a cycling training device intended to support a bicycle equipped with a front part and a rear part on front and rear articulated supports respectively, which are incorporated into a frame, said articulated supports allowing the swinging movements of the bicycle in at least one longitudinal and/or transverse plane with respect to the frame.

9 Claims, 6 Drawing Sheets

(56) References Cited

U.S. PATENT DOCUMENTS

| | | | | |
|---|---|---|---|---|
| 2017/0072254 | A1* | 3/2017 | Ryu | A63G 31/16 |
| 2019/0118058 | A1 | 4/2019 | Bass et al. | |
| 2020/0122011 | A1* | 4/2020 | Papadopoulos | A63B 69/16 |
| 2024/0350884 | A1* | 10/2024 | Salmenautio | A63B 69/16 |

* cited by examiner

CYCLING TRAINING DEVICE

CROSS-REFERENCE TO RELATED APPLICATIONS AND PRIORITY

This patent application claims priority from International Patent Application No. PCT/ES2021/070818 filed Nov. 12, 2021.

OBJECT OF THE INVENTION

The object of the invention falls within the technical field of sports, specifically in the sector related to cycling and training simulation in said sector.

Specifically, the object of the invention is a cycling training device with articulated supports that simulates the transverse and longitudinal swinging movement of a bicycle linked to a transmission during training for a user, with the bicycle remaining suspended over said device.

BACKGROUND OF THE INVENTION

In the sports field of cycling there are various forms of training, some of them implemented to be carried out inside a room, there being a development in the world of cycling towards the creation and development of new platforms, the appearance of training rollers and increasingly sophisticated bicycles; producing an exponential growth of said articles and platforms.

Until the appearance of cycling training rollers, one of the conventional forms of training was the use of a stationary bicycle inside a room, simulating the exercise of a conventional road bicycle.

Stationary bicycles use a brake based on mechanical or magnetic friction to exert effort and not perform the "empty" pedalling action. Likewise, the low-impact movement involved in the operation does not exert excessive impact on the joints and does not involve performing sporadic movements as in other types of sports equipment. However, the use of the stationary bicycle as a cycling training method results in the problem that it is not comparable with the training that a user could perform in reality, that is, the swinging, powers, changes of pace of a person that performs a physical activity with a bicycle on the road or other terrain cannot be simulated with a stationary bicycle because it is supported in a fixed position.

Faced with this problem, the development of transmission rollers and other products arises in order for the training or cycling activity carried out within a room to be comparable with that which can be carried out outside of it, either by bicycles used to travel on the road or mountain bikes that are used in other terrains, using the operation of a stationary bicycle as a basis but incorporating a commercial bicycle on said training rollers.

It is customary to use a transmission roller to warm up before competitions or when weather conditions prevent a user from going outside to train. Said rollers are aimed at training the "advanced" user who, due to lack of time or schedules, is not able to go out to train on the road or, as mentioned, because the weather conditions are not the most suitable for carrying out said activity.

In recent years, rollers have become popular in which the rear wheel of the bicycle is replaced and the movement is transmitted from the bottom bracket to said roller, which rotates and is linked to a motor brake that offers resistance simulating that a user is in an area with a certain slope.

However, although the implementation of rollers represents an advantage over the use of a stationary bicycle as a training or practice method within the cycling sector, said conventional rollers present a series of disadvantages such as, for example, lack of immersion in the physical activity carried out by an advanced user, due to the fact that the simulation obtained with respect to reality differs as it is a static roller, without the possibility of swinging that can emulate the real movement that a person makes when riding a bicycle on the road or paths.

Furthermore, another disadvantage of both rollers and other devices designed to emulate the behaviour of a bicycle on the road is the stability of said devices or rollers.

When a user attempts to overcome the resistance offered by the motor brake or magnetic brake to resemble a slope, said user needs to ride the bicycle in an upright posture or even standing, increasing the swinging of the bicycle. If the resistance is high and, therefore, the effort on the part of a user is also high, the swinging performed when pedalling a bicycle can destabilise the system, causing injuries to the user due to a fall.

This destabilisation occurs because the rear fork of a bicycle that engages with the roller replaces the rear wheel, varying the centre of gravity of the bicycle-user assembly because there is a fixed support point on the fixed, decreasing that centre of gravity to the plane of the surface where the device rests instead of being centred on the pedals.

Likewise, the fact that the rear roller and therefore the rear part of the bicycle does not swing can cause muscle and joint injuries to a user due to the effort to maintain stability on the bicycle connected to the device. When pedalling stationary on a roller, the same body position is maintained for a long period of time, causing some areas to be overloaded more than others.

For example, at a muscular level, the vastus medialis and the psoas are muscles that are subjected to an extra load, since maintaining the same position implies that these muscles are constantly activated, leading to overloads and potentially causing tendinopathy.

Furthermore, in recent years new platforms have emerged via the Internet that seek more professional training, allowing a user to compete against other athletes or simply enjoy changing environments by simulating road slopes, inclines, etc. This development has gained a large number of followers.

DESCRIPTION OF THE INVENTION

The cycling training device object of the invention intends to solve the problems explained above by incorporating a bicycle in an elongated frame with a front area and a rear area and with two articulated supports respectively in each area and that swing in a longitudinal and/or transverse plane of the frame, and therefore, allowing the incorporated bicycle to swing. Said bicycle has a front part, a rear part and a transmission connected to the pedals. Specifically, the front part is supported by the front articulated support and the rear part is linked to a resistance unit that rests on the rear articulated support; or in the case of a stationary bicycle where the resistance unit is supported thereon, the front part is supported by the front articulated support and the rear part is supported by the rear articulated support.

The resistance unit allows a user to immerse themselves in the physical activity by simulating the movements they would make when standing up to overcome the resistance offered by pedalling, swinging due to a change in slope, etc.

Additionally, the device is designed in such a way that the centre of gravity of the complete device-bicycle-user assembly remains suspended at a point such that the stability of a person is maintained when they are on the bicycle, being able to move with total freedom and avoid injuries due to the configuration of the invention to obtain said centre of gravity and prevent the user from falling, additionally reducing pressure on muscles and joints.

The articulated supports, in turn, have joints that enable swinging movements in the longitudinal and/or transverse plane of the frame.

Said resistance unit is equipped with a wheel linked to the transmission connected to the pedals, such that the aforementioned wheel rotates by means of a user pedalling.

In turn, said wheel is linked to a braking assembly that may include at least one magnetic brake, at least one flywheel, belts, etc. The wheel transmits the rotation movement to the braking assembly, leveraging the kinetic energy to provide resistance to the user when pedalling. The braking assembly is fully or partially covered by a casing.

Furthermore, both the front area and the rear area of the frame may comprise crossbars supported on one or more posts, the joints of the articulated supports being coupled either to the crossbars or to the posts; and extending from the posts, said areas comprise tubular portions that are coupled to each other in a fixed manner or can be coupled to an intermediate area of the frame in a telescopic and facing manner, allowing the frame to be adjusted in distance to facilitate the coupling of a bicycle of any size.

The front and rear articulated supports are equipped with a central body and connecting rods that articulate said central bodies at one end and the joints at the opposite end, facilitating and/or allowing the additional swinging movement of the central bodies in transverse planes with respect to the frame.

It must be noted that the central body of the front articulated support has an articulated adapter that allows the front part of the bicycle to be coupled; and that the central body of the rear articulated support is used to support the resistance unit or, incorporating another additional articulated adapter, similar to the one mentioned, to support the rear part of the bicycle, such that the movement of said support directly causes the movement of the resistance unit and/or the bicycle coupled in the invention.

Another notable feature of the invention is that the rear or front articulated support can also include a tensioning element, preferably the rear articulated support, linked to an additional joint, similar to the established joints; said tensioning element being essentially elastic, such as, for example, a spring the vertical variation of which due to the effort transmitted by the swing can cause the swinging movement of the supports to be blocked in the transverse plane of the frame.

In this way, the articulated supports swing from back to front and vice versa, in the longitudinal plane of the frame, due to the fact that the elasticity of the tensioning element is converted into rigidity, being an element the length of which does not vary.

Likewise, the frame may incorporate a tensioning assembly that comprises at least one fixing plate located on the frame, a tensioning support that extends from said fixing plate with the possibility of rotating about the axis thereof; and an elastic band fixed at one of the ends thereof to said tensioning support and connected at the opposite end with the front or rear articulated support.

The tension of the band is regulated with the help of the tensioning support, either by wrapping around it by rotating the same or by fixing it at different points of the tensioning element, etc., such that the greater the tension the elastic rubber acquires, the greater the restriction of swinging movement of the rear or front articulated support occurs.

Finally, it should be noted that the frame and all the elements that make it up can have a cylindrical or parallelepiped cross section, the manufacture thereof being performed using profiles. Furthermore, the joints of the articulated supports, as well as the articulated adapters, can be ball joints that allow movement in various degrees of freedom to achieve the described technical effect of swinging in different transverse and/or longitudinal planes with respect to the frame, in a manner similar to the joints established in the invention and mentioned above.

DESCRIPTION OF THE DRAWINGS

As a complement to the description provided herein, and for the purpose of helping to make the features of the invention more readily understandable, in accordance with preferred exemplary embodiments thereof, said description is accompanied by a set of drawings constituting an integral part of the same, which by way of illustration and not limitation, represent the following.

PREFERRED EMBODIMENT OF THE INVENTION

Some examples of preferred embodiments of the cycling training device object of the invention are presented with the help of the above-mentioned figures.

Figure 1:
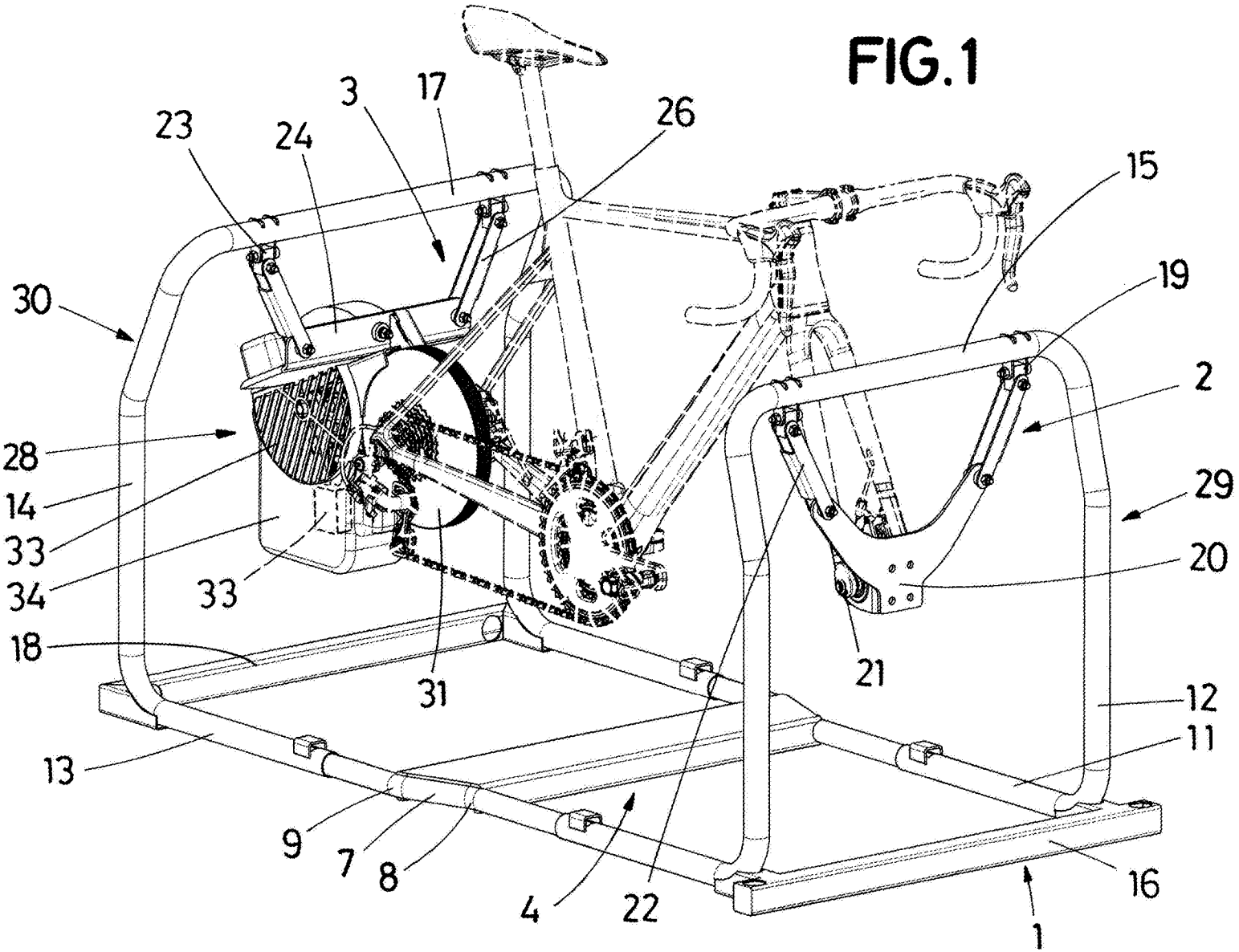
FIG. 1 shows a perspective view of a first exemplary embodiment of the cycling training device.

FIG. 1 shows a first embodiment of the cycling training device intended to facilitate the coupling of a bicycle equipped with a front part, a rear part and a transmission connected to pedals, said device comprising a frame (1) with a front area (29) and a rear area (30), a front articulated support (2) that comprises first joints (19) connected to the front area (29) of the frame (1) and which is intended to support the front part of the bicycle and with the capacity to swing with respect to a longitudinal plane and/or a transverse plane of the frame (1).

The cycling training device further comprises a rear articulated support (3) connected to the rear area (30) of the frame (1) and comprising second joints (23), also with the capacity for swinging movement in a plane transverse to the frame (1) and/or in a plane longitudinal to the frame (1) in coordination with the swinging movement of the front articulated support (2). The rear articulated support (3) is intended to be directly or indirectly connected to the rear of the bicycle.

In this first exemplary embodiment, the device is equipped with a resistance unit (28) that rests on the rear articulated support (3) and is intended to support the rear part of the bicycle and provide resistance to the pedalling of the user of the bike. Said resistance unit (28) comprises a wheel (31) coupled to the transmission of the bicycle and a braking assembly (33) linked to the wheel (31) and that leverages the kinetic energy produced by the rotation thereof to regulate the braking intensity on said wheel (31). Both the braking assembly (33) and the wheel (31) are fully or partially enclosed by a casing (34).

On the one hand, the frame (1) incorporates in the front area (29) thereof one or more front posts (12), preferably two, which can support a front crossbar (15), with the possibility that the first joints (19) are connected either to the front posts (12) or to the front crossbar (15).

The front area (29) of the frame (1) may also include a front transverse reinforcement (16) connected to the front posts (12) and one or more front tubular portions (11) that extend backwards from said front posts (12).

On the other hand, the frame (1) also incorporates in the rear area (30) thereof one or more rear posts (14), preferably two, which can support a rear crossbar (17), and the second joints (23) may be, in turn, connected to the rear posts (14) or the rear crossbar (17). The rear area (30) of the frame (1) may incorporate a rear transverse reinforcement (18) connected to the rear posts (14) and one or more rear tubular portions (13) that extend forward from said rear posts (14).

Likewise, the frame (1) is equipped with an intermediate area (4) that couples to the front tubular portions (11) at a first end (8) and to the rear tubular portions (13) at a second end (9) in a telescopic manner to facilitate the longitudinal adaptation of the front and rear areas (29, 30) of the frame (1) to the size of the bicycle.

FIG. 1 also shows the arrangement of elements of the front articulated support (2) of the cycling training device, said front articulated support (2) additionally comprising a front central body (20) equipped with a first articulated adapter (21) where the front part of the bicycle is supported and first connecting rods (22) that articulate with the front central body (20) and each of the first joints (19), in such a way that the swinging movement of the bicycle causes the integral movement of the front central body (20) and which in turn determines the rotation and variation in the inclination of the first connecting rods (22), giving rise to the swinging movement of the front articulated support (2) in the plane transverse to the frame (1).

Next, the rear articulated support (3), the movement of which is integral with that of the front articulated support (2), comprises a rear central body (24) where the resistance unit (28) is supported, and second connecting rods (26) that each articulate at one of the ends thereof on both sides of the rear central body (24), and at the opposite ends thereof, each of the second joints (23), in such a way that the swinging movement of the bicycle causes the integral movement of the rear central body (24) and which in turn determines the rotation and variation in the inclination of the second connecting rods (26) giving rise to the swinging movement of the rear articulated support (3) in the plane transverse to the frame (1).

Figure 2:
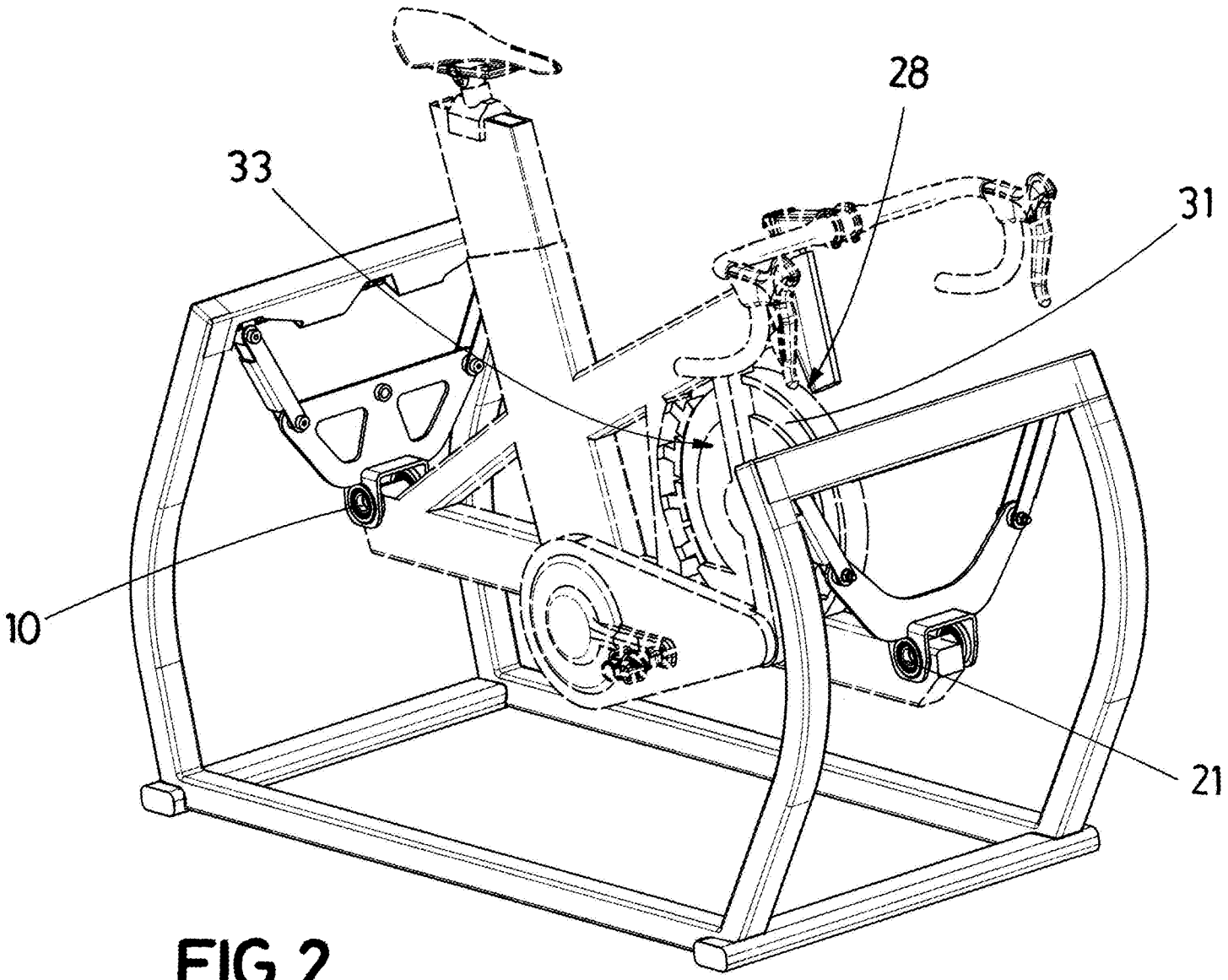
FIG. 2 shows a perspective view of a second exemplary embodiment of the cycling training device.

With the help of FIG. 2, a perspective view of a second exemplary embodiment of the invention is shown where the resistance unit (28) is located on the bicycle, also being linked to the transmission thereof. It also shows how the rear central body (24) can incorporate a second articulated adapter (10) to support the rear part of the bicycle, thereby achieving the same effect as the first exemplary embodiment.

Figure 3:
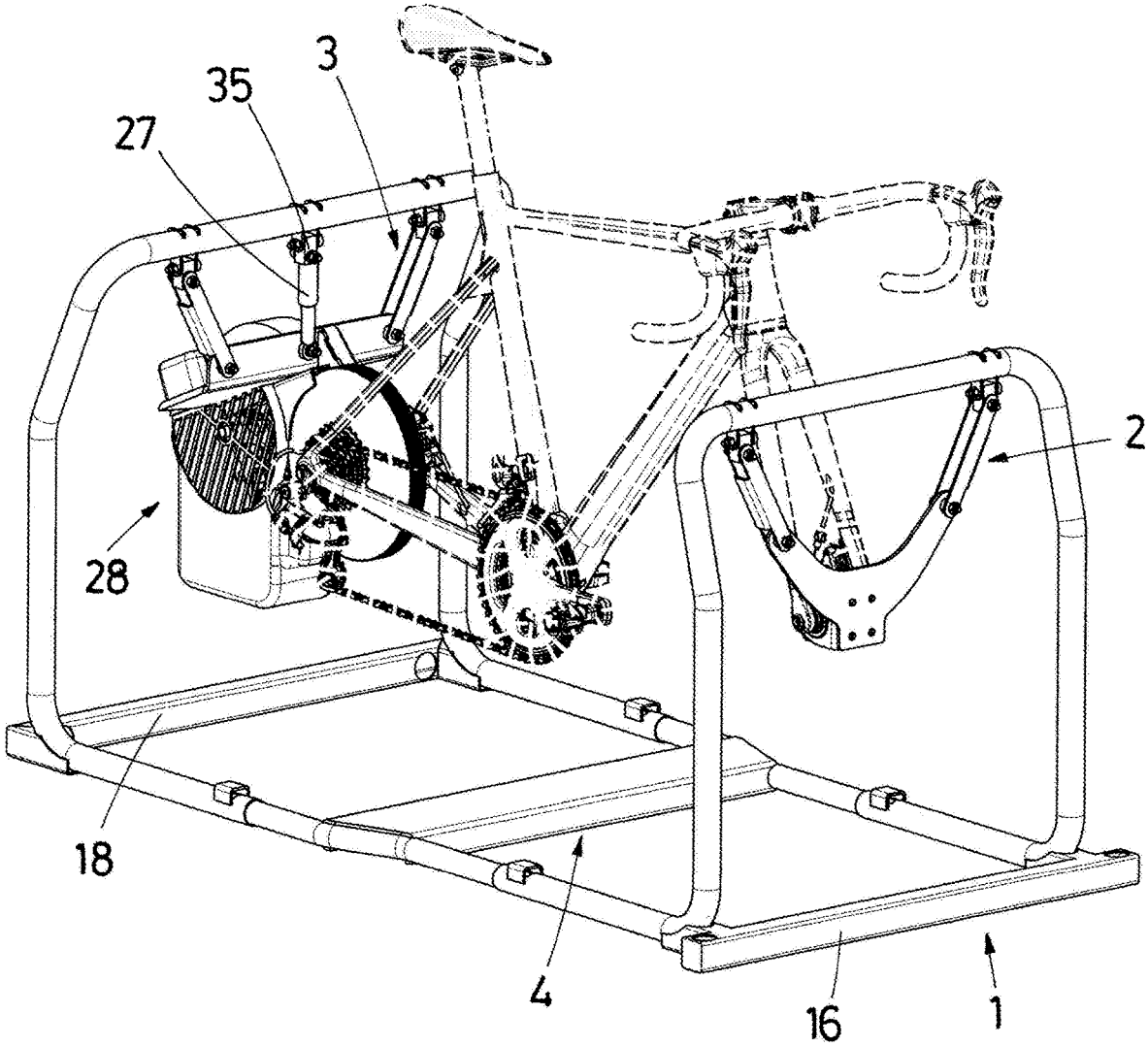
FIG. 3 shows a perspective view of the first exemplary embodiment of the cycling training device with the tensioning element incorporated.

FIG. 3 shows how the front or rear articulated support (2, 3) can include a third joint (35) capable of rotating in the longitudinal and/or transverse plane of the frame (1) and a tensioning element (27) linked to said third joint (35) and to the front or rear central bodies (20, 24), essentially being elastic and capable of blocking the swinging movement in the transverse plane of the frame (1) of the third joint (35), and, consequently, of the first or second joints (19, 23) and therefore of the front and/or rear articulated support (2, 3).

The tensioning member (27) may be an elongate spring or other elastic piece or assemblies. Said spring has a preload tension such that when the swinging movement of the front articulated support (2) or the rear articulated support (3) in the transverse plane of the frame (1) generates a force in the spring equal to the preload tension, said spring stiffens preventing the swinging movement in the transverse plane of the frame, the rear and front articulated supports (3, 2) swinging from backwards and forwards and vice versa in said longitudinal plane of the frame.

Figure 4:
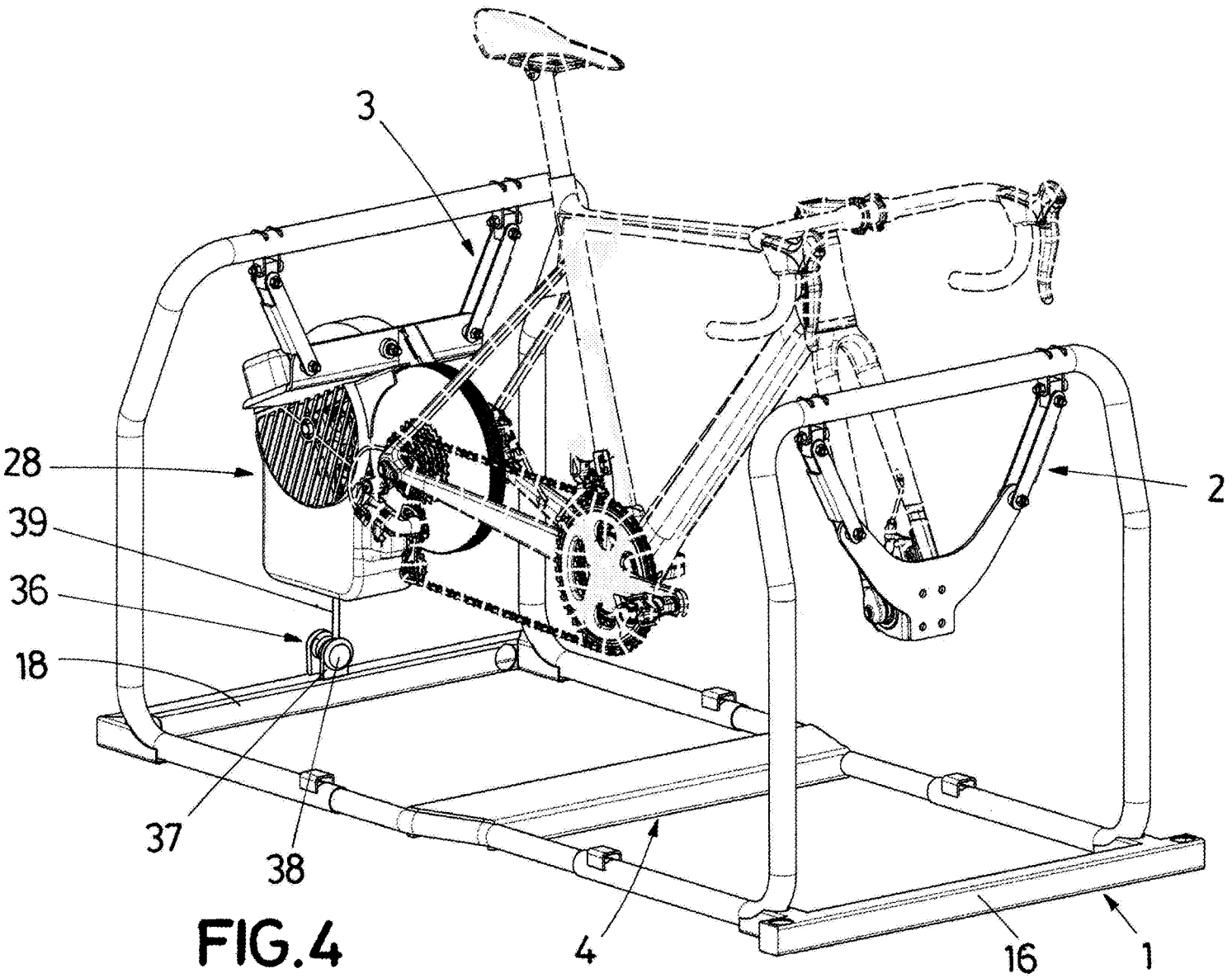
FIG. 4 shows a perspective view of the first exemplary embodiment of the cycling training device with the tensioning assembly incorporated.

Furthermore, FIG. 4 shows a perspective view of the device object of the invention that can incorporate a tensioning assembly (36), replacing or not the tensioning element (27), said tensioning assembly (36) being formed by at least one fixing plate (37) fixed front (29) or rear (30) area of the frame (1), at least one tensioning support (38) that extends from said fixing plate (37); and at least one elastic band (39) linked to the tensioning support (38) at one end and at the opposite end connected to the front articulated support (2) or to the rear articulated support (3), intended to prevent the swinging of the front articulated support (2) or the rear articulated support (3) in the transverse and/or longitudinal plane of the frame (1) by means of the tension acquired as it is tensioned with the help of the tensioning support (38).

Figure 5B:
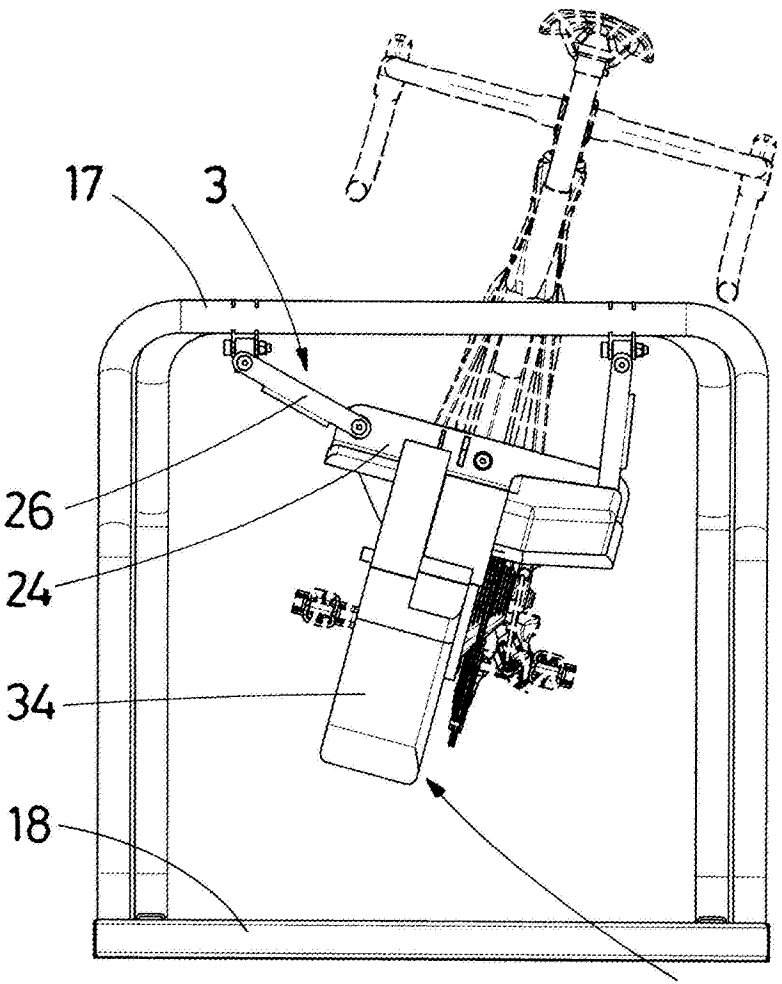
FIG. 5B shows a rear view of the cycling training device representing the swinging movement in the transverse plane of the frame.
Figure 5A:
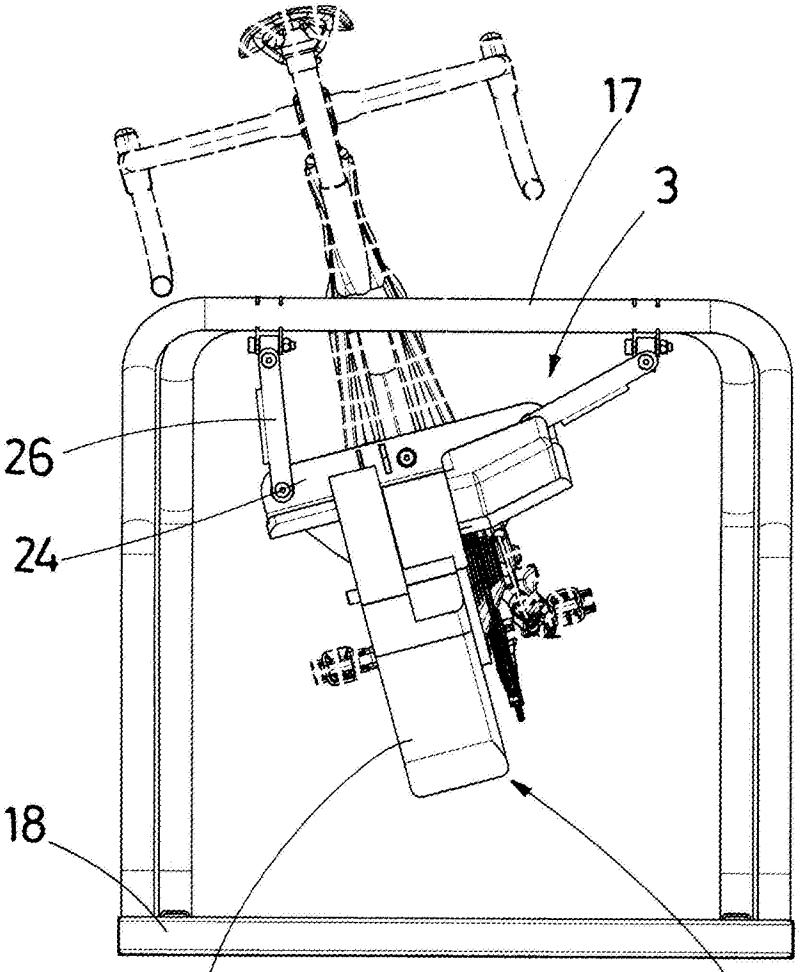
FIG. 5A shows a rear view of the cycling training device representing the swinging movement in the transverse plane of the frame.
Figure 6A:
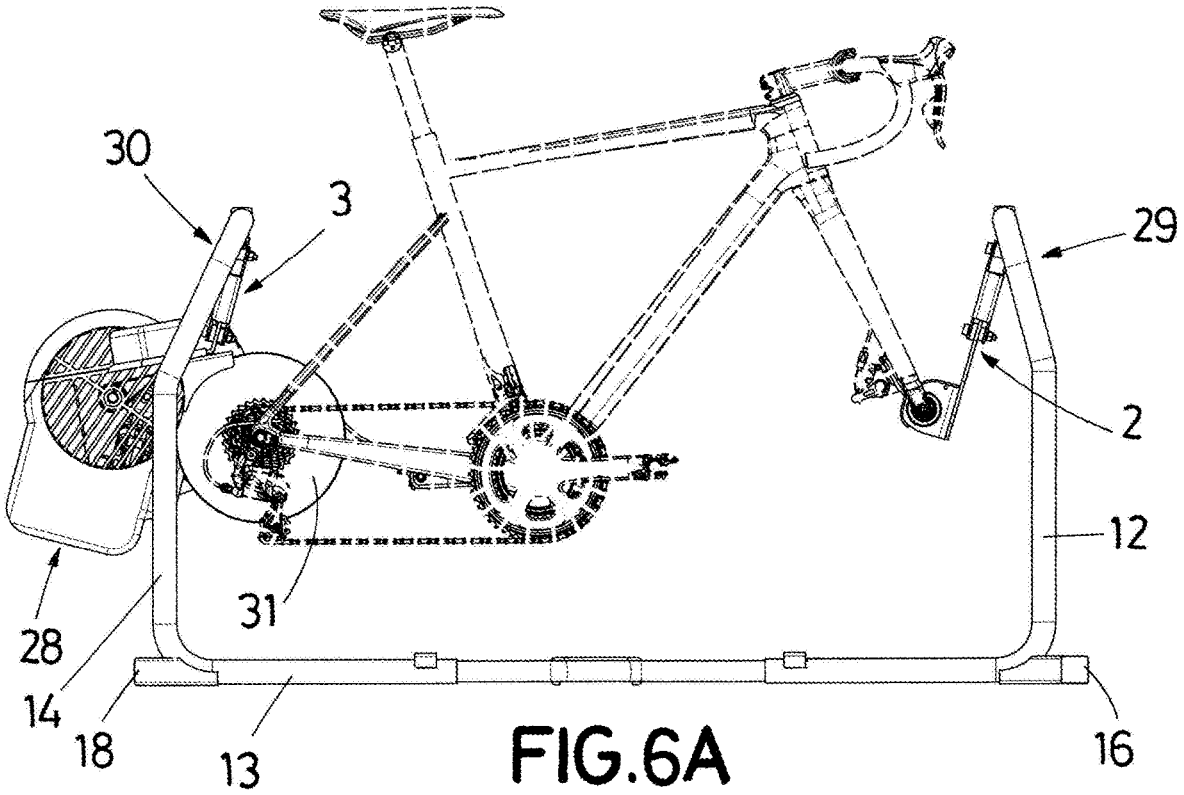
FIG. 6A shows a side view of the cycling training device representing the backward swinging movement in the longitudinal plane of the frame.
Figure 6B:
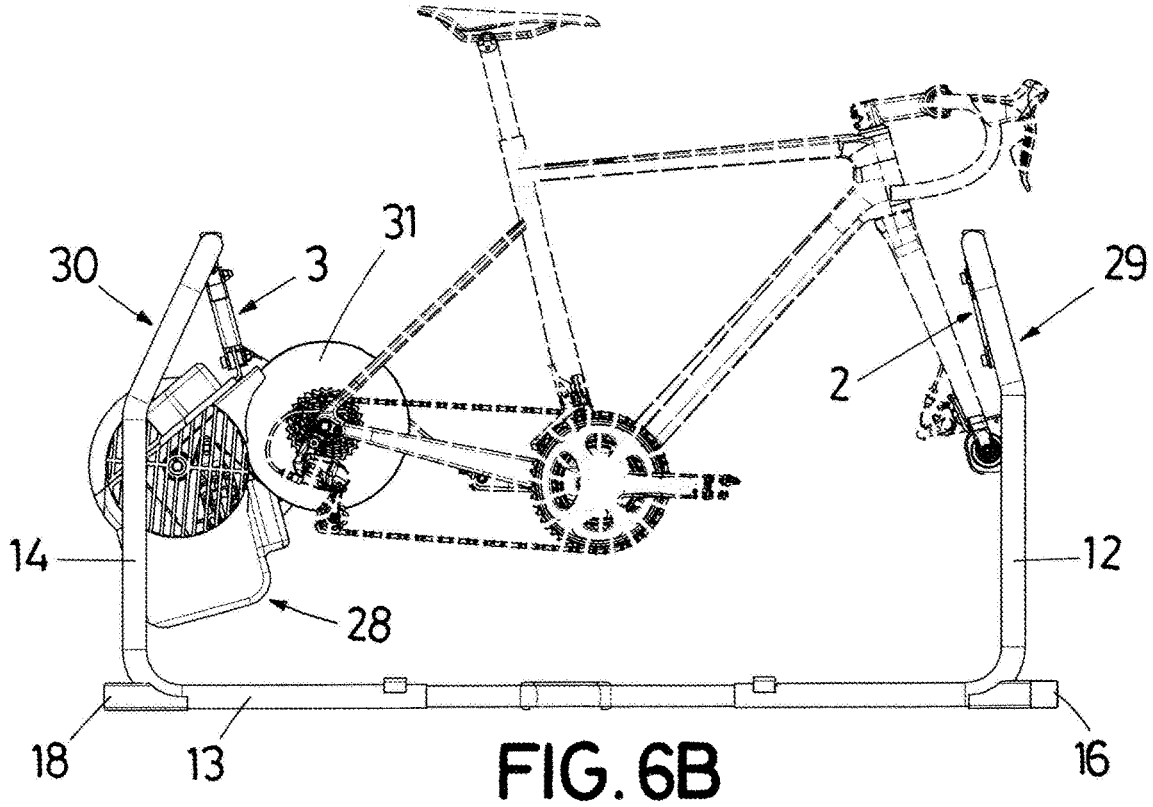
FIG. 6B shows a side view of the cycling training device representing the forward swinging movement in the longitudinal plane of the frame.

Lastly, FIGS. 5A, 5B, 6A and 6B are included with the intention of showing the movements that allow the articulated supports (2, 3) to be applied to a bicycle coupled to said articulated supports (2, 3), FIGS. 5A and 5B showing the swinging movement of the device object of the invention in the transverse plane of the frame (1) and FIGS. 6A and 6B showing the tilting movement of the training equipment in the longitudinal plane of the frame (1).

The invention claimed is:

1. A cycling training device intended to facilitate the coupling of a bicycle equipped with a front part, a rear part and a transmission connected to pedals, wherein the cycling training device comprises:

an elongate frame equipped with a front area and a rear area, a front articulated support configured to support the front part of the bicycle, and which has the capacity for swinging movement in a plane transverse to the frame and/or in a plane longitudinal to the frame, which is equipped with first joints connected to the front area of the frame, a front central body equipped with a first articulated adapter intended to support the front part of the bicycle, and first connecting rods that each articulate at one of the ends thereof on both sides of the front central body, and at the opposite ends thereof, each of the first joints, in such a way that the swinging movement of the bicycle causes the integral movement of the front central body and which in turn determines the rotation and variation in the inclination of the first connecting rods, giving rise to the swinging movement of the front articulated support in the plane transverse to the frame; and a rear articulated support that has the capacity for swinging movement in a plane transverse to the frame and/or in a plane longitudinal to the frame in coordination with the swinging movement of the front articulated support, said rear articulated support intended to be linked to the rear part of the bicycle, and which is equipped with second joints connected to the rear area of the frame, a rear central body which has a second articulated adapter intended to support the rear part of the bicycle, and second connecting rods that each articulate at one of the ends thereof on both sides of the rear central body, and at the opposite ends thereof, each of the second joints, in such a way that the swinging movement of the bicycle causes the integral movement of the rear central body and which in turn determines the rotation and variation in the inclination of the second connecting rods giving rise to the swinging movement of the rear articulated support in the plane transverse to the frame, wherein the cycling training device additionally comprises a resistance unit that rests on the rear articulated support or on the bicycle and that is intended to be connected to the bicycle transmission, equipped with:

a wheel that can be coupled to the transmission of the bicycle, which rotates said wheel by the action of the pedals, a braking assembly connected to the wheel that regulates a braking intensity on the wheel, and a casing that fully or partially encloses the braking assembly and the wheel.

2. The cycling training device according to claim 1, wherein the front area of the frame comprises one or more front posts that enable the support of a front crossbar and wherein the first joints are connected to the front posts or the front crossbar.

3. The cycling training device according to claim 2, wherein the front area of the frame additionally comprises a front transverse reinforcement connected to the front posts and one or more front tubular portions that extend backwards from said front posts.

4. The cycling training device according to claim 2, wherein the rear area of the frame additionally comprises one or more rear posts that enable the support of a rear crossbar and wherein the second joints are connected to the rear posts or the rear crossbar.

5. The cycling training device according to claim 3, wherein the rear area of the frame additionally comprises a rear transverse reinforcement connected to the rear posts and one or more rear tubular portions that extend forward from said rear posts.

6. The cycling training device according to claim 4, wherein the frame additionally comprises an intermediate area that couples with the front tubular portions at a first end and with the rear tubular portions at a second end in a telescopic manner to facilitate a longitudinal adaptation of a distance between the front area and the rear area of the frame and, therefore, to a longitudinal size of the bicycle.

7. The cycling training device according to claim 1, wherein the rear articulated support or the front articulated support additionally comprise:

a third joint capable of rotating with respect to a front crossbar or a rear crossbar, and an elastic tensioning element coupled to an articulated joint and linked to the front central body or the rear central body a movement of which is integral with a movement of a third articulated joint and capable of blocking a swinging movement in the transverse plane of the frame of the third articulated joint, consequently, of the first or second articulated joints; and thus, of the rear articulated support and front articulated support.

8. The cycling training device according to claim 1, wherein the frame incorporates a tensioning assembly that comprises:

at least one fixing plate fixed in the front or rear area of the frame, at least one tensioning support that extends from said fixing plate; and at least one elastic band fixed at one end to the tensioning support and connected at an opposite end to a rear articulated support or with a front articulated support, whereby the tensioning of said elastic band diminishes the swinging of the rear articulated support and thus, the front articulated support, or vice versa, in the transverse and/or longitudinal plane of the frame.

9. The cycling training device according to claim 1, wherein the first joints are ball joints and/or the second joints are ball joints.

* * * * *